United States Patent [19]

Stokes

[11] 3,990,426

[45] Nov. 9, 1976

[54] TENNIS BALL THROWING MACHINE

[76] Inventor: Gilbert Stokes, 1105 LaJolla Way, Sacramento, Calif. 95822

[22] Filed: July 22, 1975

[21] Appl. No.: 598,009

[52] U.S. Cl. ..... 124/56; 124/41 R; 124/45; 124/49; 124/51 R; 294/19 A

[51] Int. Cl.[2] ..... F41F 1/04; A63B 47/02

[58] Field of Search ..... 124/11 R, 41, 45, 49, 124/50, 51 R, 56, 72; 42/87, 88; 89/33 R, 33 BB, 33 C; 56/328 R; 214/353, 356; 221/64, 197, 307, 310; 273/25, 26 R, 26 D, 29 R, 29 A, 32 F, 162 E; 294/19 A, 99 R

[56] References Cited

UNITED STATES PATENTS

| | | | |
|---|---|---|---|
| 667,580 | 2/1901 | Rogers | 294/99 R |
| 1,937,828 | 12/1933 | Macdonald | 294/19 A |
| 2,760,807 | 8/1956 | Watson | 294/19 A |
| 2,788,630 | 4/1957 | Nisbet | 56/328 R |
| 3,371,950 | 3/1968 | Stap | 294/19 A X |
| 3,584,614 | 6/1971 | Horvath | 124/11 R |
| 3,695,246 | 10/1972 | Filippi et al. | 124/11 R |
| 3,855,988 | 12/1974 | Sweeton | 124/11 R |
| 3,905,349 | 9/1975 | Nielsen et al. | 124/11 R |
| 3,911,888 | 10/1975 | Horvath | 124/11 R |
| 3,926,465 | 12/1975 | Hoagland et al. | 294/19 A |

*Primary Examiner*—Richard T. Stouffer

[57] ABSTRACT

Tennis balls are introduced via a removable ball pick-up magazine through a ball port in a wall of a pipe into a stream of air flowing through the pipe towards a barrel. Air flows freely through the barrel and through the ball port past a normally open flexible flap valve which permits a ball to pass, but which momentarily seals against the curved wall of the pipe in response to back pressure after a ball passes through the port and chokes the free flow of air through the barrel.

8 Claims, 11 Drawing Figures

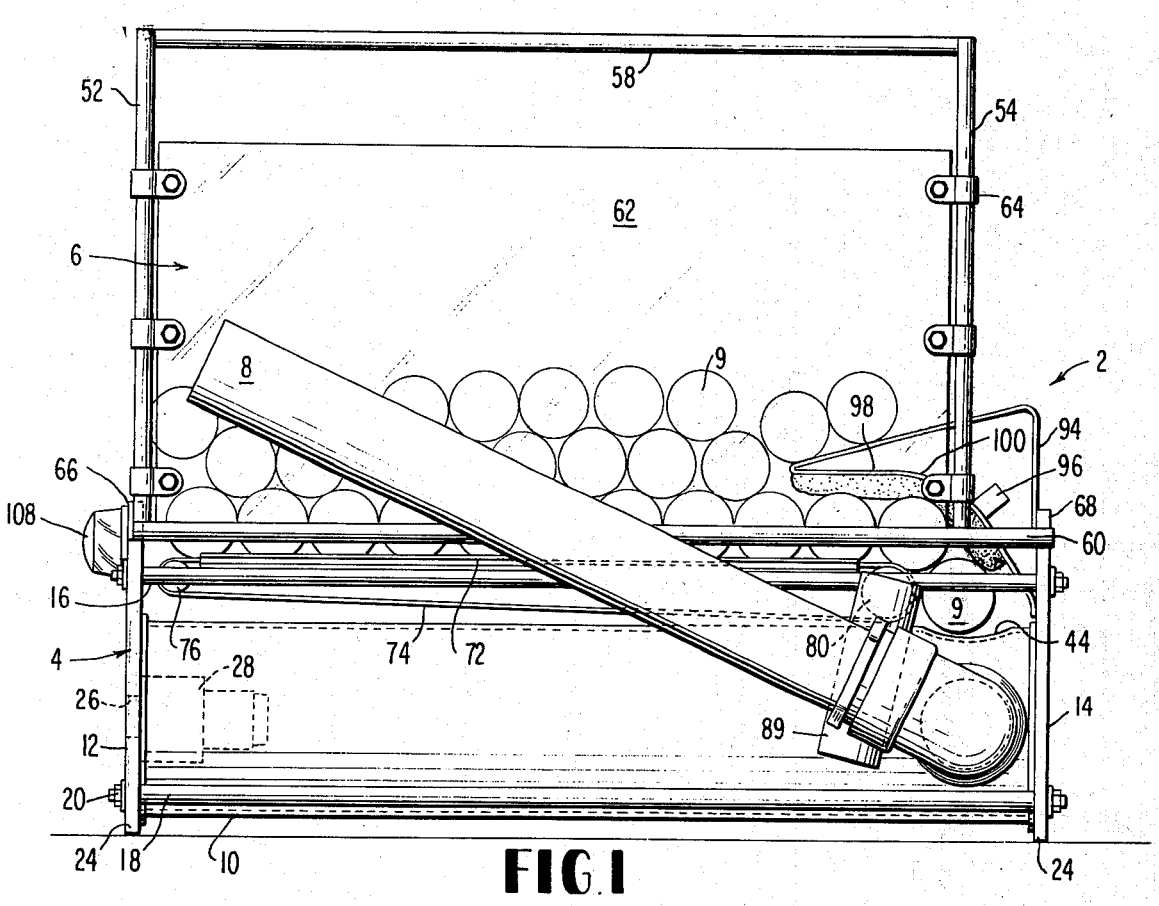
FIG. 1
FIG. 2
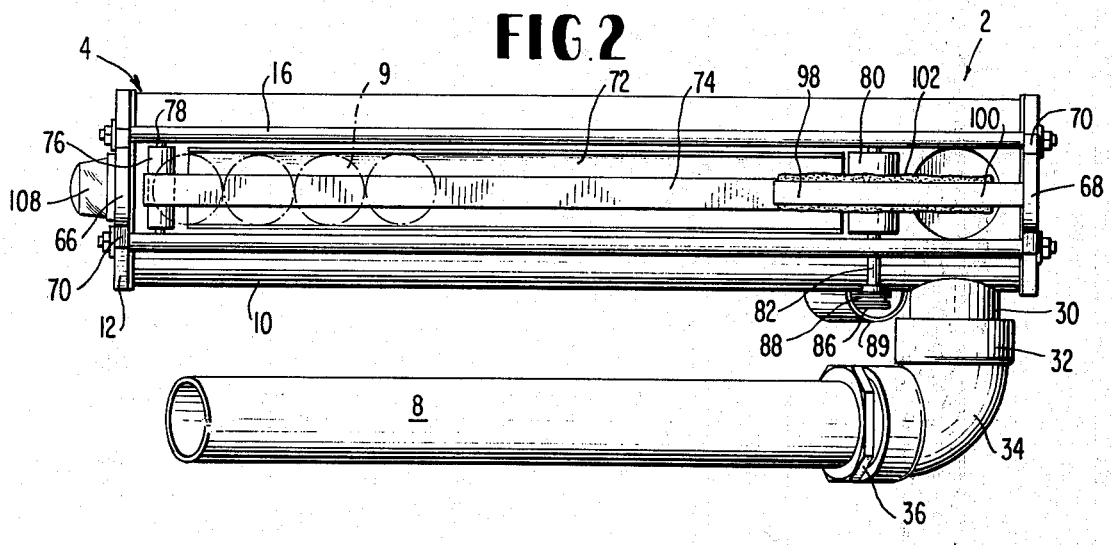
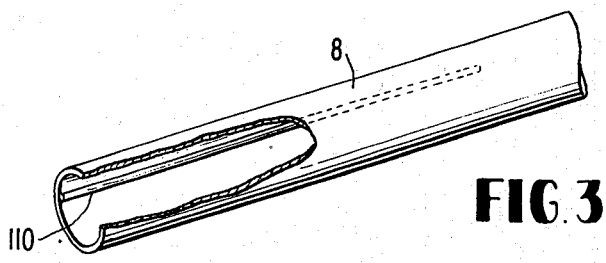
FIG. 3

FIG. 8
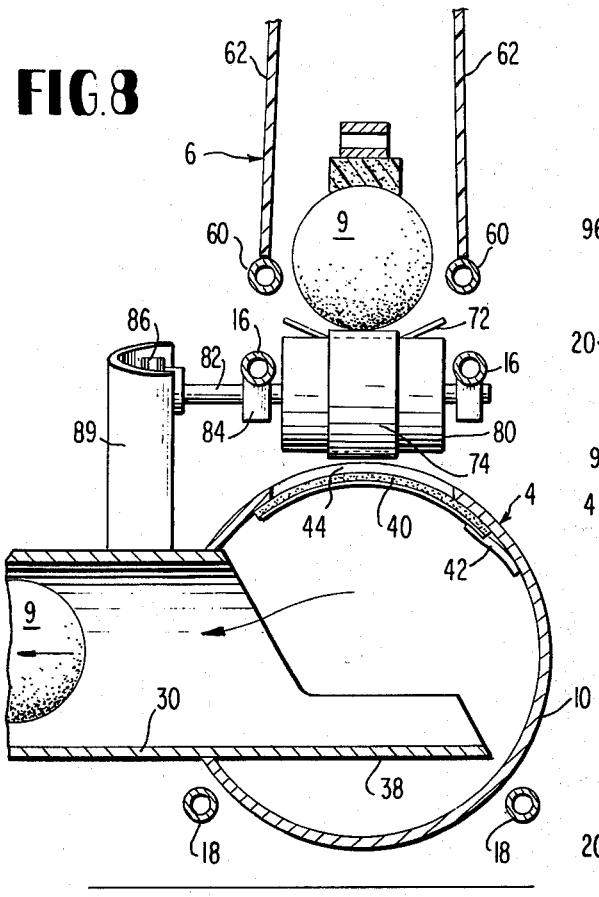
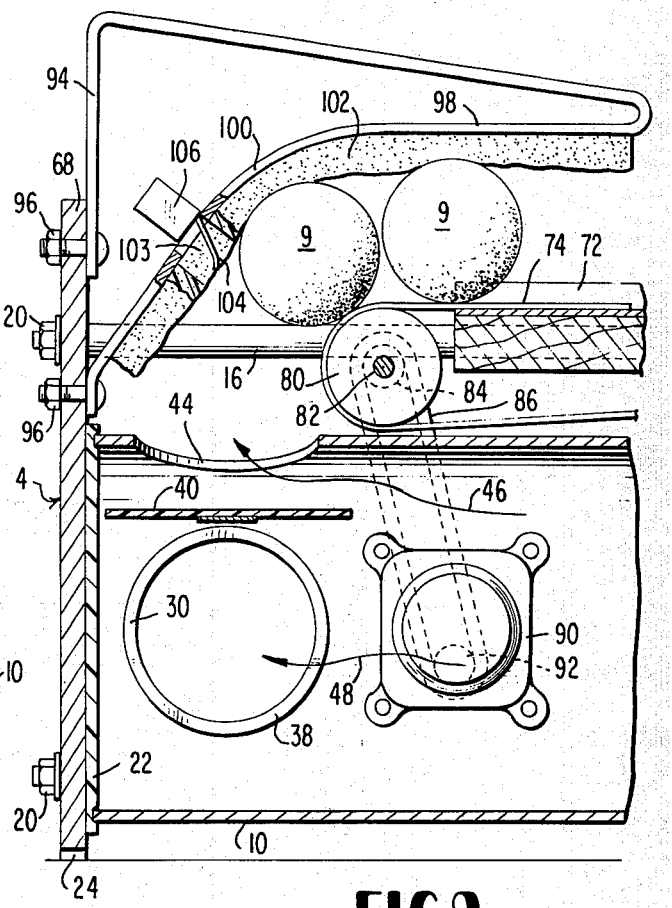
FIG. 9
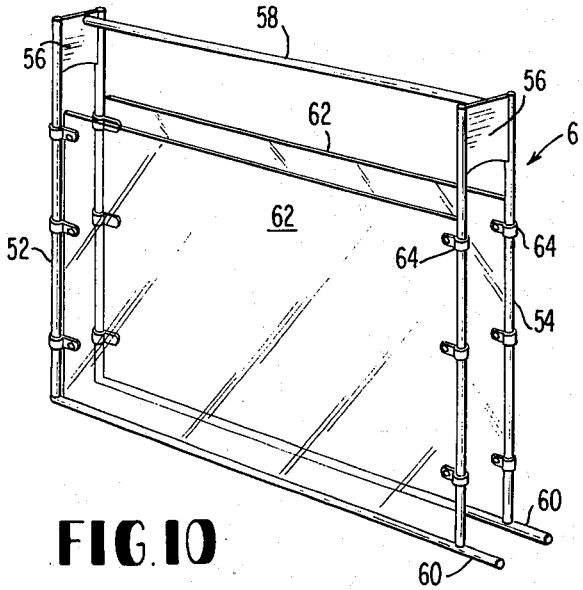
FIG. 10
FIG. 11
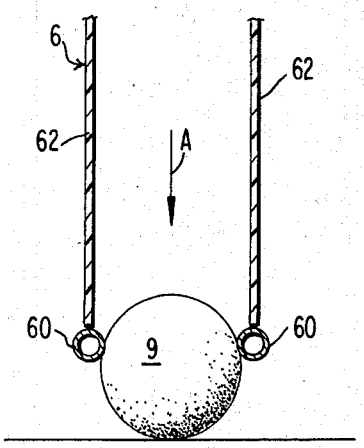

TENNIS BALL THROWING MACHINE

FIELD OF INVENTION

Mechanical Guns And Projectors, Fluid Pressure.

OBJECTS

The primary object of this invention is to provide a tennis ball throwing machine which will periodically expell tennis balls with considerable but uniform force in a desired direction. More particularly, it is intended to provide such a machine that will utilize to maximum efficiency a relatively small source of fast-moving air moving under normally low pressure, but whose pressure and velocity are momentarily greatly increased as each ball is expelled.

To this end, it is intended now to provide an air pump which forces air through a comparatively large cross-section pipe and thence to both a normally open flap valve, through which tennis balls are successively introduced into the air stream, and to a barrel of reduced cross section as compared with the large pipe. As each ball starts to enter the barrel, it causes a back pressure which momentarily closes the flap valve and, for that moment, the velocity of the air behind the ball is greatly increased, and the ball is forcefully expelled through the barrel. A further and desired characteristic of the machine is that the expulsion force exerted upon each ball is substantially the same, so that each ball is thrown in the same trajectory with the same force.

Another object is to provide a magazine removably attached to the body of the machine, and which can be used for picking up tennis balls off the ground without having to stoop over. More specifically, it is intended to provide a frame having a pair of flat side walls joined together at their tops so that their bottom edges can be spread apart. Rods along the bottom edges of the side balls normally prevent balls in the magazine (when the latter is unattached to the machine) from falling out. When the bottom walls are forced down over a ball on the ground, the sides of the magazine spread apart at the bottom sufficiently for the ball to "pop" into the magazine; and when the lower edges of the magazine are pressed down into place on top of the machine, the rods spread apart sufficiently to permit the balls therein to drop by gravity onto a conveyor belt running along the top of the machine.

In tennis ball throwing machines wherein the balls are retained in a hopper-type magazine and fed by gravity therefrom and wherein a plurality of balls are disposed side-by-side in dispersed planes, the balls tend to jam together and arch, and some means must be found for stirring them to break up the jams. An object of this invention is to provide a magazine which retains the balls in single file. More specifically, it is intended to provide a magazine having two flat sides normally disposed in vertical planes, the sides being spaced from one another so as to permit one file of balls, i.e., a ball stack which is a plurality of balls long and a plurality of balls high, but only one ball wide. This has been found to greatly facillitate the gravity feed of balls through the bottom of the magazine. To further overcome any remaining tendency of balls to jam in the magazine and to provide for uniformly timed feeding of balls into the throwing machine, a further object is to provide on the machine top a conveyor belt which moves along beneath the bottom of the magazine. This not only rotates the balls in the lower portion of the magazine, but it also feeds them in a row, one by one, towards the point at which they enter the pneumatic part of the machine. A still further object is to impose an impedance at the end of the conveyor belt run to insure that only one ball at a time will enter the pneumatic part of the machine and for applying a retrograde rotation to the balls so as to cause a time delay between the successive ball feeds.

These and other objects will be apparent from the following specification and drawings, in which:

FIG. 1 is a side elevation of the barrel side of the ball throwing machine;

FIG. 2 is a plan view of the machine with the magazine removed;

FIG. 3 is a view, partly broken away, showing the end of the barrel;

FIG. 8 is a view similar to FIGS. 6 and 7, but showing the flap valve momentarily closed immediately after the ball has passed through it;

FIG. 9 is a fragmentary vertical cross section along lines 9—9 of FIG. 5 through the rear portion of the machine illustrating the sequential ball feed mechanism;

FIG. 10 is a perspective view of the magazine removed from the body of the machine; and, FIG. 11 is a fragmentary vertical section through the lower portion of the magazine illustrating the ball pick-up motion.

Figure 4:
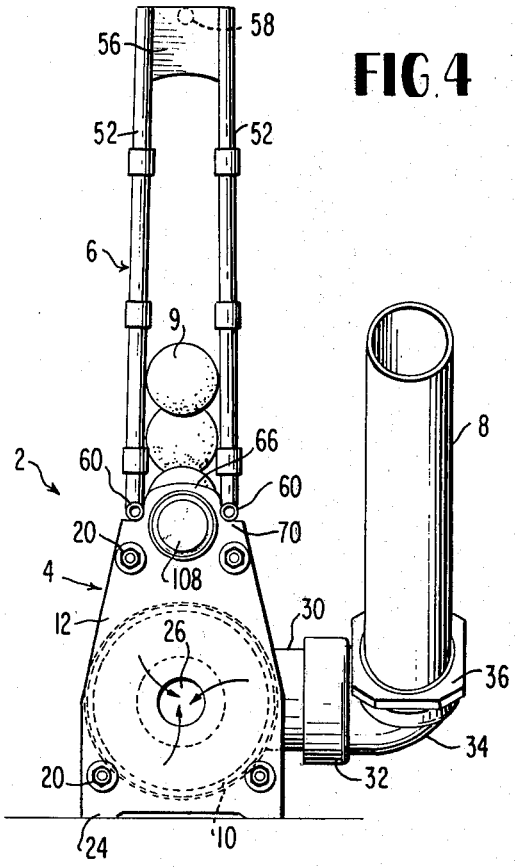
FIG. 4 is a front elevation.

Referring now to the drawings in which like reference numerals denote similar elements, the ball-throwing machine 2 comprises a main body portion 4 upon the top of which a magazine 6 is removably mounted, and along side of which a barrel 8 is disposed. Tennis balls 9 collected in magazine 6 are pneumatically expelled through barrel 8.

The main body 4 includes a relatively large pipe 10, in this instance, a pipe 6 inches in diameter, a front end plate 12, and rear end plate 14 clamped to the ends of pipe 10 by nuts 20 on the ends of tie rods 16 and 18. Rear end plate 14 is sealed to the end of pipe 10 by a gasket 22, and both end plates have feet 24 which support the large pipe 10 off the ground. An air intake opening 26 on front end plate 12 admits air to a blower 28, and extending from one side of the relatively large pipe 10 is a smaller pipe 30 connected by a swivel joint 32 to an elbow 34, the latter being connected by a coupling nut 36 to barrel 8 so that the barrel may be pointed upwardly or downwardly. The diameter of barrel 8 is about 2½ inches, slightly larger than the diameter of a tennis ball, and the diameter of pipe 30 is intermediate the diameters of the large pipe 10 and barrel 8, for example, 3 inches.

Figure 6:
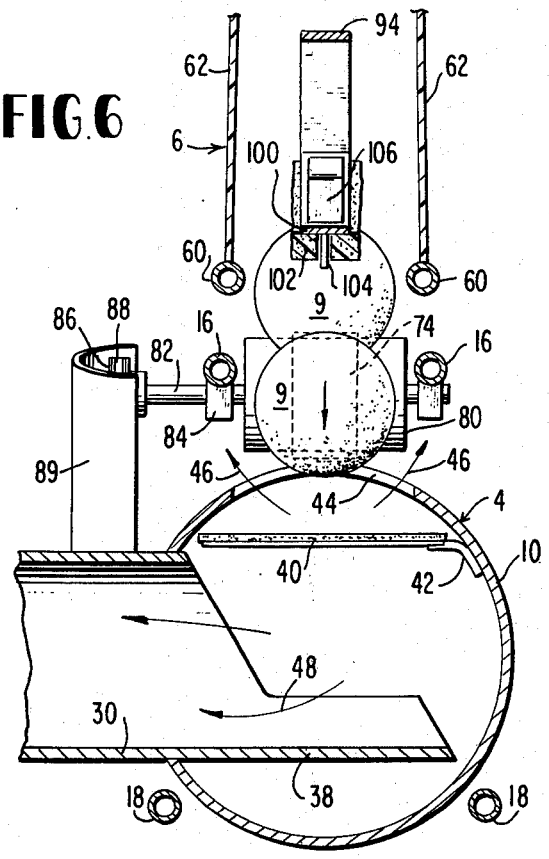
FIG. 6 is a vertical cross section through the rear end of the machine, showing the flap valve in its normal position before a ball reaches it.
Figure 7:
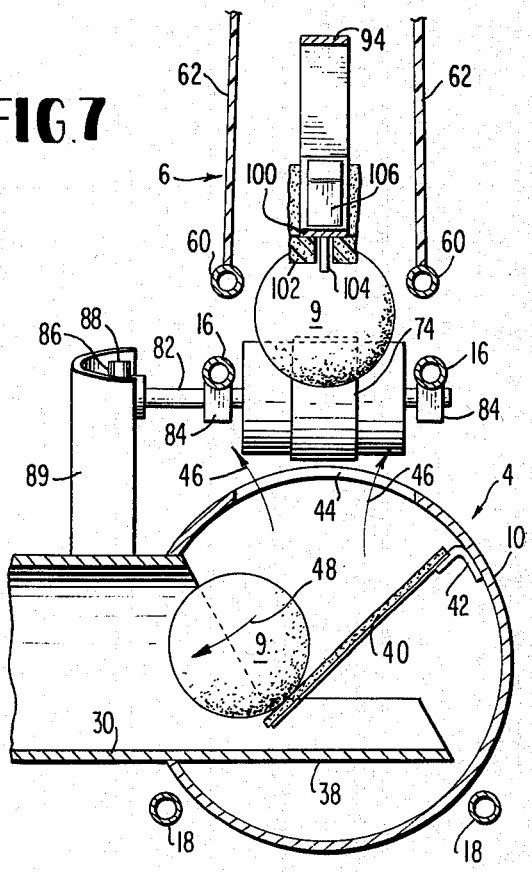
FIG. 7 is a view similar to FIG. 6, but showing the ball passing the flap valve.

The intermediate size pipe 30 has on its inner end a scoop-shape portion 38 which lies between a flexible flap valve 40, which valve is pivotally connected by a rubber hinge to the inner side of the relatively large pipe 10. The flexible flap valve 40 lies beneath a ball port 44 in the top of the pipe 10, but, as will be apparent from the ensuing description of operation, flap valve 40 normally "floats" in a generally horizontal position as shown in FIGS. 6 and 9 so that it does not normally close ball port 44. Thus, between the moments when balls are being expelled, there are two air escape paths, one as indicated by the arrows 46 past valve 40 and through ball port 44 in the top of pipe 10 and the other as indicated by the arrows 48 through intermediate pipe 30 and barrel 8.

Magazine 6 consists of two pairs 52 and 54 of normally parallel rods which are normally held in inverted U-shape by plates 56 at their upper ends. Extending between plates 56 is a rod 58 which serves as a spacer between plates 56 and as a handle for transporting and manipulating the magazine. Connected to the lower ends of each of the rods in pairs 52, 54 are rods 60 and above each rod 60 there is a side panel 62 held on to the rods by clips 64. At least one and preferably both of side panels are of transparent plastic material so that the ball content of the magazine may be observed.

The spacing between the side panels is sufficient to accommodate only one file of tennis balls. This file may be several balls long and several balls high, but only one ball wide.

Figure 5:
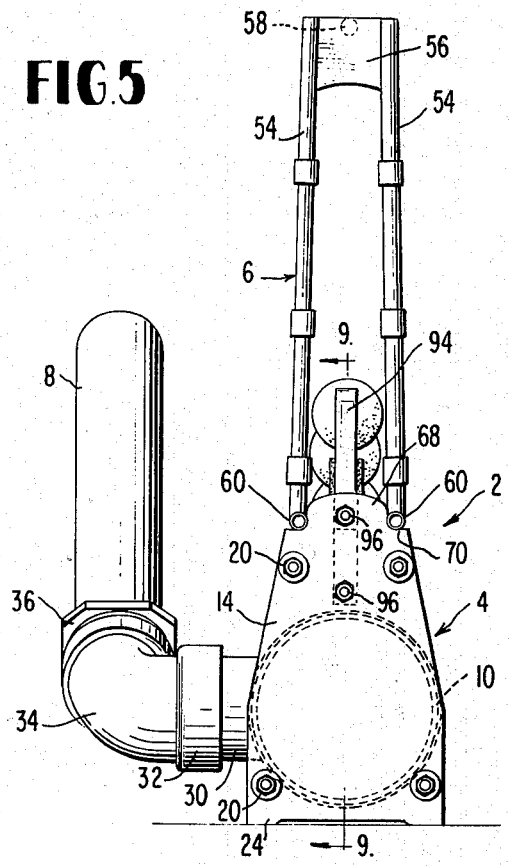
FIG. 5 is a rear elevation.

The front and rear end plates 12 and 14 have convexly curved top portions 66 and 68, respectively, the lower portions of the curves terminating in L-shaped pockets 70 in which the rods 60 running along the lower sides of the magazine 6 rest, as shown in FIGS. 1, 4 and 5. The spacing between rods 60, when the magazine is removed from the main body portion 4, is slightly less than the diameter of a tennis ball. However, rod pairs 52 and 54, being connected only at their tops by plates 56, are sufficiently springy so that when the magazine 6 is pressed down over a tennis ball 9, as indicated by the arrow A in FIG. 11, the opposite sides of the ball are slightly compressed, and the rods 60 which function as lips along the lower sides of the magazine spread apart sufficiently to pass by the opposite sides of a tennis ball and permit it to "pop up" into the magazine. The ball remains trapped in the magazine when the lower opposite sides of the magazine spring back to their normal position, and the balls in the magazine cannot escape through the open ends of the magazine because the spacing between the rods in pairs 52, 54 is not sufficient to permit the balls to fall out between. However, when the magazine 6 is pressed down onto the top of the main body portion 4, the curved upper ends 66, 68 of the end plates spread apart the rods 60 (FIG. 4– FIG. 8) sufficiently to permit the balls 9 to feed downwardly by gravity from the open lower end of the magazine.

Between the sides of a trough 72 extending along the top of the main body portion 4 is the upper run of an endless conveyor belt 74 which passes around a passive roller 76 rotatively supported towards the front of the machine by shaft 78 which is supported by tie rods 16. Towards the rear end of the main body portion is a drive roller 80 whose drive shaft 82 is suspended from tie rods 16 by shaft hangers 84. Drive shaft 82 has on its end a sprocket 86 which is driven by an endless chain 88 drivingly engaged with a sprocket (not shown) on the drive shaft 90 of an electric motor 92 (FIG. 9). A guard plate 89 shields the drive chain. It will thus be understood that when motor 92 is energized, the upper run of the endless conveyor belt 74 moves towards the rear of the machine. This not only advances the tennis balls from the magazine towards the rear end of the machine, but, in addition, causes a constant churning about of the balls which tend to bunch together in the magazine and immediately beneath the lower end thereof.

A bracket 94 whose ends are bolted to the rear end plate as at 96 has a relatively straight portion 98 overlying the rear end portion of the upper run of conveyor belt 74, and a downwardly curving portion 100 which overlies the ball port 44 in the upper side of the large pipe 10. The underside of bracket 94 is surfaced with a sponge rubber strip 102 which together with the end portion of the conveyor belt, provides a slight squeeze pass for the balls and imposes a frictional resistance on the tops of balls 9 as they move along the end of the conveyor belt, thus imparting a slight spin to the balls as they move off the end of the conveyor belt run. This imposes a delay in the time between which each successive ball will finally drop into ball port 44 onto the then generally horizontal flexible flap valve 40. Near the end of the curved portion 100 of bracket 94 there is a window 103 in sponge rubber strip 102, through which window extends the arm 104 of a micro-switch 106 which, through an electrical circuit (not shown) energizes a warning light 108 on the front end plate 12, and this lets the player who is practicing with the machine know that very shortly thereafter a tennis ball will come sailing out of barrel 8. If he desires that the ball have a spin, he may mount a strip of friction material 110 on one side or the other of barrel 8.

In operation, after a number of tennis balls have been collected in magazine 6 and the latter has been installed onto the top of the main body 4, the electrical circuits (not shown) for the blower 28 and belt drive motor 92 are energized, whereupon the endless conveyor belt 74 feeds a row of tennis balls 9 towards the rear of the machine. As a ball passes micro switch 106, warning light 108 flashes on, whereupon the ball falls onto flexible flap valve 40 and forces it downwardly (FIG. 7), and then the ball rolls into the end of the intermediate sized pipe 30. Whereas, with no back pressure from pipe 30, flexible flap valve 40 will remain in a general horizontal position (FIG. 6) and will not close ball port 44, as soon as a ball rolls off the then depressed flap valve 40 (FIG. 7) and enters pipe 30, a back pressure develops and the flexible flap valve 40 is forced upwardly (FIG. 8) by pressure differential so as to seal ball port 44 closed until the ball emerges from the open end of barrel 8. However, as soon as the back pressure is released, flap valve 40 returns to its generally horizontal FIG. 6 position.

Velocity is imparted to the ball using the principle of kinetic energy and Bernouilli's principle of fluids and motion. A large volume of air is moved at a high rate of speed through the large pipe and then through a pipe of smaller cross section and this change in size of the pipes creates an increase in velocity as the air moves from the larger to the smaller. The tennis balls are introduced into the air flow. The energy contained in the moving air mass is transferred to and absorbed by the increase velocity imparted to the ball. Air flow through the system is continuous. Once entered into the air flow the ball accelerates continuously until ejected from the end of the smaller diameter barrel.

Various velocities are achieved by increasing or decreasing the length of the barrel, or by increasing the diameter of the barrel in relation to the size of the ball. A longer length will increase the velocity by subjecting the ball to the force imparted over a longer period of time. A close fit between the barrel and the ball will allow less air to flow around the ball, thus imparting more of the air's velocity and energy to the ball. Trajectory for a given velocity of the ball is changed by modifying the elevation of the end of the barrel from which the ball is ejected. Because the machine is capable of providing various velocities, various trajectories and various spins to the ball, virtually any shot encountered on the tennis court can be duplicated, including serves, volleys, lobs, and ground strokes. All of these various shots can be accomplished with top spin, side spin, under spin, etc. Once set, the machine will throw successive balls along substantially the same trajectory and at substantially the same velocities. A comparatively low power fan or blower can be used since its normal load between ball throwings is very low, and its maximum loadings occur only during the brief intervals between when a ball enters pipe 30 and emerges from the end of barrel 8. While the intermediate pipe 30 between large pipe 10 and barrel 8 has been found to be particularly successful, the transition or reduction in said between large pipe 10 and barrel 8 may be shorter or of different configuration.

The invention is not limited to the specific forms or details described and shown herein, but is intended to cover all substitutions and equivalents within the scope of the following claims.

I claim:

1. A pneumatic tennis ball throwing machine comprising a pipe, a ball-ejecting barrel of lesser effective cross section than the pipe, means for connecting one end of the barrel to the pipe, means for forcing a substantially continuous stream of air in one direction through said pipe and thence through the barrel, a ball feed device, and means for introducing balls from said feed device into said air stream upstream of said one end of the barrel, said means comprising a ball port through a curved wall of the pipe, which wall is concave on the inner side thereof, a flexible flap valve means for closing said ball port, means mounting said flexible flap valve onto a portion of the inner side of said pipe which lies below and at one side of said port, said flap valve means being characterized in that it is normally at least partly open to provide an air bleed passage therepast to the atmosphere and being sufficiently flexible to conform in curvature to the curved inner wall of the pipe so as to close said ball port in response to back pressure resulting from at least partial choking by the ball of said air stream as the ball moves with the airstream from the pipe towards the barrel.

2. A pneumatic ball throwing machine as claimed in claim 1, the means for connecting the pipe to one end of the barrel comprising a second pipe of lesser effective cross-sectional area than the first mentioned pipe and of greater effective cross sectional area than the barrel.

3. A ball throwing machine, comprising a body having an upwardly facing ball entry port therein, a ball magazine on said body, said magazine having a normally horizontal elongate open bottom through which a row of balls may emerge downwardly by gravity, an endless flexible conveyor belt having a normally horizontal upper run disposed beneath the open bottom of the magazine and one end of which is disposed towards the ball entry port, and means for driving said flexible conveyor whereby to move towards the ball port the balls which have emerged from said magazine, means adjacent said end of said flexible conveyor for imposing an impedance upon said balls whereby to effect a time delay between successive balls as they move along a path from said conveyor belt run towards said ball port, said means for imposing an impedance on said balls comprising an element extending along said path and forming a squeeze pass therefore, said element comprising an elongate member overlying said path and having a resilient member on the underside thereof for engaging said balls whereby said balls roll along said resilient member as they move along said path.

4. A ball throwing machine as claimed in claim 3, said resilient member having a downwardly facing friction surface.

5. A pneumatic tennis ball throwing machine comprising a pipe, an air intake, air impelling means for forcing air in one direction from said intake along a path through the pipe, a ball-projecting barrel of lesser effective cross section than said pipe, air conduit means for connecting the barrel to the pipe, said air conduit means and said barrel constituting a normally open outlet for said air, absent a ball therein, a ball port through a wall of the pipe alongside said path, which wall is curved on the inner side thereof, a normally open generally flat flexible flap valve means, and pivot means mounting said flexible flap valve means on the inner side of said pipe at a location at one side of said port, said pivot means providing for swinging movement of said flexible flap valve about an axis which extends in the direction of air flow past said port from said intake towards said conduit means, said flap valve means being sufficiently flexible to conform to the curvature of the pipe around said ball port in response to back pressure prevailing in said pipe upon choking of said outlet.

6. In combination a tennis ball throwing machine comprising a body, a device in said body for projecting a tennis ball, and a magazine removably mounted on said body for supplying balls to said device, said body having a laterally spaced pair of magazine mounting elements thereof providing upwardly convex surfaces, said magazine comprising a pair of panels having upper and lower portions, mounting means for normally maintaining said panels in substantially parallel vertical planes spaced from one another a predetermined distance, said mounting means providing connections between the upper portions of said panels while permitting the lower portions thereof to spread apart from one another, and lip means projecting inwardly from lower edge portions of said panels, said mounting means being characterized by springiness whereby when said lip means are pressed downwardly over a tennis ball, they spring apart to permit a ball to squeeze therebetween, the span of said upwardly convex surfaces on said elements being sufficiently great that when the lip means are pressed downwardly thereon, said lip means are thereby spread apart more than said predetermined distance.

7. The combination claimed in claim 6, the means for maintaining said side wall comprising two pair of rods normally vertically disposed, elements for holding the upper ends of the rods in each pair together, each pair of rods and their associated one of said holding elements forming inverted U's, spacer means for maintaining said elements in spaced relation, said panels each having opposite end edges connected to corresponding rods of each pair, said lip means comprising a pair of rods connecting the lower ends of corresponding rods of each pair.

8. The combination claimed in claim 7, said panels being of transparent material.

* * * * *